United States Patent [19]

Williams

[11] 4,293,778

[45] Oct. 6, 1981

[54] ANTI-THEFT SCREEN CONSTRUCTION

[75] Inventor: William H. Williams, Palos Verdes Penninsula, Calif.

[73] Assignee: Sandstone, Inc., La Mirada, Calif.

[21] Appl. No.: 11,099

[22] Filed: Feb. 12, 1979

Related U.S. Application Data

[63] Continuation-in-part of Ser. No. 883,488, Mar. 6, 1978, abandoned.

[51] Int. Cl.[3] ..... G08B 13/12

[52] U.S. Cl. ..... 307/147; 340/550

[58] Field of Search ..... 340/550, 545, 652; 200/DIG. 12; 307/116, 147; 361/170; 333/18 R

[56] References Cited

U.S. PATENT DOCUMENTS

| | | | |
|---|---|---|---|
| 181,078 | 8/1976 | Larned | 200/DIG. 12 |
| 943,368 | 12/1909 | Orance | 340/550 |
| 3,051,935 | 8/1962 | Willson | 340/550 |
| 3,594,770 | 7/1971 | Ham | 340/550 |
| 3,696,373 | 10/1972 | Dunn | 340/550 |
| 3,863,242 | 1/1975 | Minton | 340/550 |
| 4,146,293 | 3/1979 | Mutton | 340/545 |

*Primary Examiner*—L. T. Hix
*Assistant Examiner*—Stafford D. Schreyer
*Attorney, Agent, or Firm*—Joseph E. Mueth

[57] ABSTRACT

A partially conductive security screen arrangement for use with an intrusion alarm system designed to operate in a normally closed sensing circuit condition and to produce a warning signal when the sensing circuit is broken, which arrangement includes conductive means overlying and bonded to a mesh screen positionable to cover an opening in a building. The conductive means is connectible at its two ends to the sensing circuit in a series relationship with the remainder of that circuit. The conductive means is positioned on the screen in a configuration preventing passage of a human being through the screen unless the conductive means is severed. Passage of a human being through the opening while the screen is in position to cover the opening therefore breaks the sensing circuit to produce a warning signal. One or more electrical switches located within a frame at the periphery of the screen may also be connected in a series relationship with the remainder of the sensing circuit, the switches being adapted to close for the screen in position covering the opening in the building and to open for the screen moved out of that position. The conductive means may include a plurality of parallel longitudinal lengths of wire connected in series with each other and with one or more transverse lengths of wire. The respective lengths of wire may be mechanically interlocked with each other and with the mesh screen at the points of intersection therebetween.

28 Claims, 12 Drawing Figures

FIG.—1
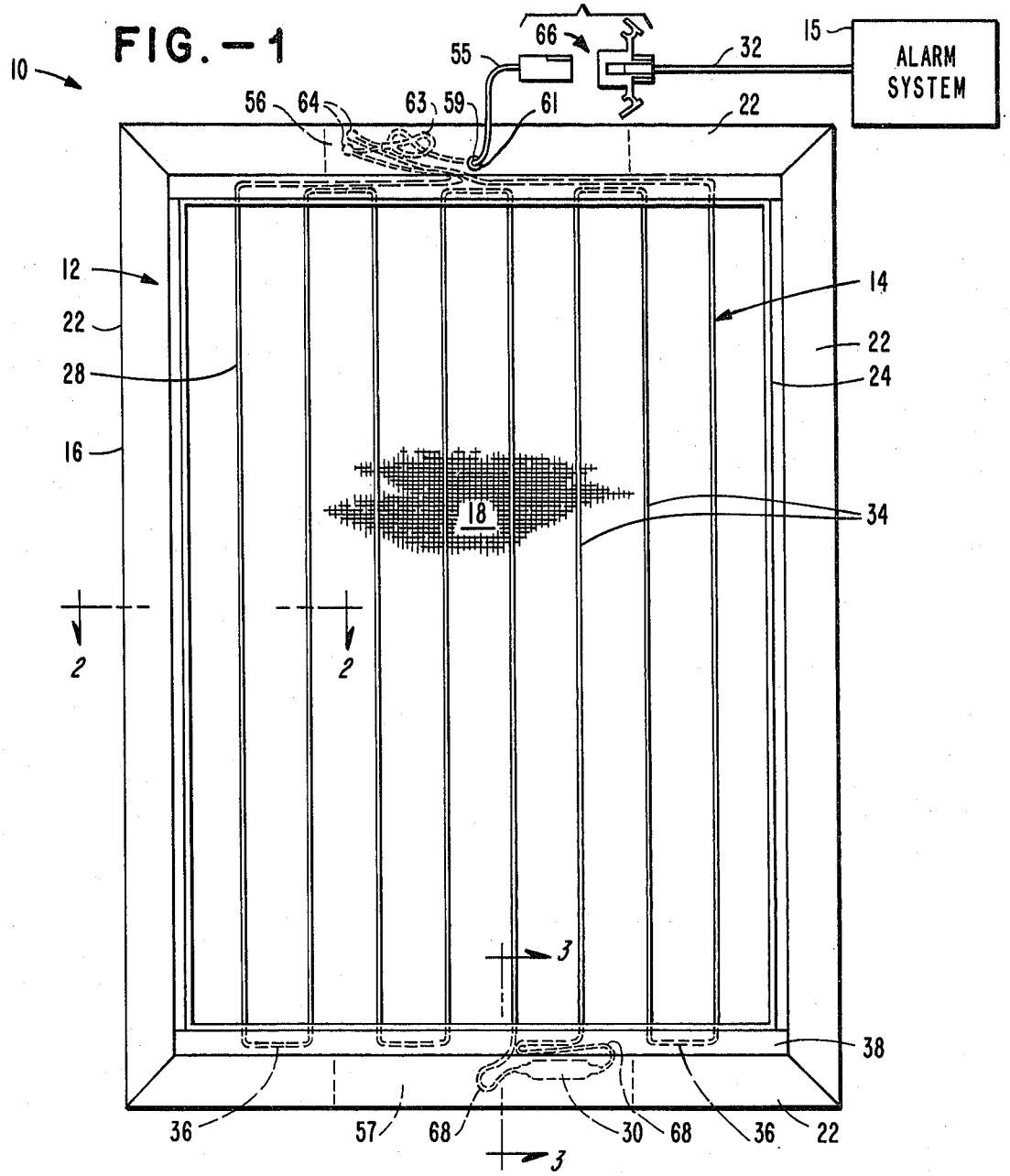
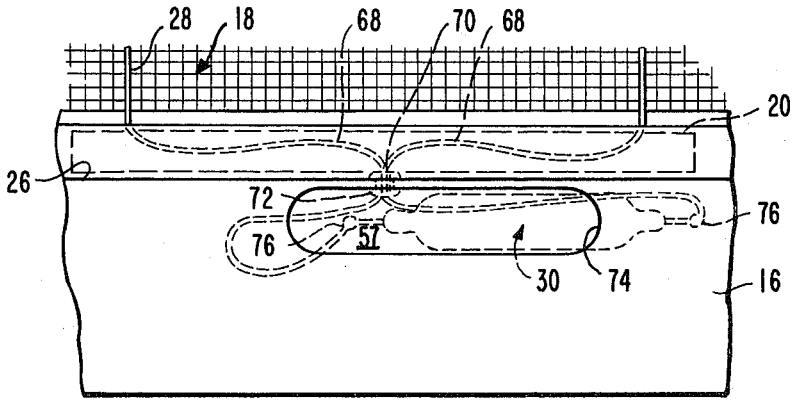
FIG.—1A

ANTI-THEFT SCREEN CONSTRUCTION

REFERENCE TO RELATED APPLICATION

This application is a continuation-in-part of copending application Ser. No. 883,488, filed Mar. 6, 1978, abandoned, entitled ANTI-THEFT SCREEN CONSTRUCTION, the teachings of which are incorporated herein.

BACKGROUND OF THE INVENTION

1. Field of the Invention

This invention relates to the intrusion alarm art, and more particularly to a security screen arrangement useful in intrusion alarm systems to secure openings in a building from unauthorized entry.

2. Description of the Prior Art

There have heretofore been proposed security bug screen arrangements having conductive portions connectible in series with a sensing circuit of an intrusion alarm system such that the alarm system will produce a warning signal when the continuity of the conductive portion is broken.

One such prior art security screen arrangement is that disclosed in U.S. Pat. No. 3,051,935 issued to Willson. The protective screen disclosed therein incorporates a series of electrically conductive parallel wire strands interwoven into the screen material itself. The wire strands have substantially the same external diameter and general appearance as the individual strands making up the screening material. The various wire strands are then connected to each other at their respective ends to form at least one continuous conductive circuit connectible in a series relationship with a sensing circuit of an intrusion alarm system to cause the alarm system to produce a warning signal when the conductive loop is broken. The Willson screen is disadvantageous primarily because the conductive strands are interwoven with the screening material. That feature precludes retrofitting existing screens with a conductive loop without replacing the screening material. Further, the ends of the parallel wire strands must be interconnected by hand with relatively short lengths of wire to form the desired continuous conductive loop. The process of manufacture of the Willson device therefore involves relatively high labor costs, precludes retrofit of existing screens and results in a configuration having a large number of splices susceptible to corrosion and malfunction.

Stitching a continuous loop of conductive wire onto the screening material has also been proposed as a method of manufacturing security screens to serve the instant purpose. While a stitching process can be used in a retrofit program, it has been found to cause puckering of the mesh screening material and sometimes damage thereof. A stitching process must also be performed on a sewing machine with the screening material off the screen frame, and can be very time consuming.

An embellishment which has been incorporated in some security screen arrangements to guard against removal of the entire screen from the opening of a building is an electrical switch which is placed in series with both the conductive wire loop and the sensing circuit of the intrusion alarm to open that circuit when the screen is removed. A magnetic reed switch, for example, has been placed in the splining used to retain the screening material within its frame such that the switch will be located adjacent a permanent magnet in a relation holding the switch closed for the screen in position over the opening. Removal of the entire screen from the opening therefore allows the switch to open, actuating the alarm. However, this configuration results in a variety of problems. One major problem is the susceptibility of the circuit to damage from corrosion, particularly at the points of electrical connection between the wires in the screen and the leads to the switch. The wiring for the switch is located in or adjacent to the exposed splining and is not effectively sealed from the elements. Moisture from the weather or from cleaning the screen is thus able to reach the points of electrical connection to corrode or short them out. Location of the glass encapsulated switch within the spline also causes it to be susceptible to damage from bending or impact of the screen frame. Perhaps the most serious drawback of this configuration is the ease with which the alarm can be circumvented. The splining, switch, screening material and all of the wiring can simply be removed together from the screen frame with the electrical circuit intact, allowing an intruder to pass through the empty frame undetected.

Another switch proposed for this purpose comprises a pair of contacts on the screen frame which are designed to be shorted by a conductive bar when the screen is in position over the opening. This switch is disclosed in the Willson patent discussed above. Such contacts, however, are exposed and therefore subject to corrosion which may interfere with the conduction of electricity thereacross. Exposed switches of any sort should also be avoided in intrusion alarms generally to reduce the possibility of circumvention by an intruder.

Therefore, in many applications it is desirable to provide a security screen arrangement which may be fabricated easily and economically either in the initial manufacture or retrofit of mesh bug screens, and in which the circuitry is as tamper-proof and corrosion resistant as possible.

SUMMARY OF THE INVENTION

Accordingly, it is an object of the present invention to provide an improved security screen arrangement.

It is another object of the present invention to provide an improved security screen arrangement which may be produced by retrofitting existing window and door bug screens without removing those screens from their frames.

It is yet another object of the present invention to provide an improved security bug screen arrangement which may be economically fabricated, will provide a long operational life and will be relatively tamper proof.

The above, and other objects of the present invention, are achieved, according to a preferred embodiment thereof, by providing a continuous electrically conductive means overlying a bug screen and bonded thereto in a configuration preventing passage of a human being therethrough unless the conductive means is severed. The conductive means is connected at its two ends in a series relationship with the sensing circuit of an intrusion alarm system designed to operate in a normally closed sensing circuit condition and to provide a warning signal when the sensing circuit is broken. The screen is positioned to cover an opening in a building such that passage of a human being through that opening for the screen in position to cover the opening breaks the sensing circuit and causes an alarm to produce a warning signal.

The screening material used to form the bug screen may be of the woven mesh type, and the conductive means may be made of wire substantially similar in diameter and appearance to the individual strands which make up the screening material. The wire may also have multiple conductor elements to increase its flexibility and resiliency. The screening material may comprise interwoven fiber glass strands to which a coating of polyvinyl chloride is applied, and the wire may be insulated with a similar polyvinyl chloride coating. The wire may then be bonded to the screen in the desired configuration either by welding the coatings on the respective elements to each other or by cementing the wire in place on the screening material.

The wire may comprise a series of equally spaced parallel longitudinal lengths extending across the screening material between opposite ends of the screen frame and connected together by relatively short lengths to form a continuous series circuit, the wire being homogeneous at the points of connection between the longitudinal lengths and the relatively short lengths.

The wire may further comprise at lease one transverse length of wire connected in series with the longitudinal lengths and the relatively short lengths and extending between opposite sides of said frame in a direction substantially perpendicular to the longitudinal lengths. The transverse lengths are bonded to and electrically insulated from the longitudinal lengths at the points of intersection within the central aperture in the screen frame. Means may be provided for mechanically interlocking the transverse lengths with the longitudinal lengths and with the screen itself at the points of intersection, such that the lengths of wire cannot be separated from each other or from the screen without breaking the sensing circuit. If the transverse lengths are spaced no more than two feet apart across the central aperture, the resulting configuration will prevent the passage of a human being through the aperture without breaking the sensing circuit and setting off the alarm. Any attempt to slit the screen between the longitudinal lengths of wire and pull the screen apart enough to allow a human being to pass will break one of the transverse lengths of wire and set off the alarm.

The screening material may be secured to the screen frame by the conventional structure of a flexible plastic spline which longitudinally engages a channel at the inner edge of the frame with the periphery of the screening material sandwiched therebetween. The relatively short portions of wire are received within the channel above the spline and may be bonded thereto to prevent removal of the spline without breaking the sensing circuit. For this purpose, both the spline and the insulation on the wire may be polyvinyl chloride (PVC), and those elements may be welded, glued or otherwise bonded together. The entire channel is then covered with a silicone or other sealer compound for further protection from the atmosphere and from tampering.

The resulting structure is highly resistant to malfunction caused by tampering or otherwise. Tampering with the screen by pulling the spline out of the channel for the purpose of removing the screen mesh from the frame will rip or break the conductive wire near its point of attachment to the spline, breaking the sensing circuit and setting off the alarm. Bonding the conductive wire to the spline in a condition overlying the spline also gives the screen a built-in stress relieving mechanism and added insulation between the conductive wires and the metallic channel. Rather than being forced into the channel beneath the spline to form a taut right angle bend over the inner lip of the channel, as in prior devices, the wire of the invention is passed over the inner lip of the channel in an essentially flat condition and bonded in that condition to the flexible spline itself. The wires of the prior devices are thus relatively rigidly anchored to a screen frame with a right angle bend of wire which acts much like a hook while the wires of the invention are resiliently mounted to the frame through the flexible spline. Any undue stress or tension which would otherwise be applied to the conductive wire of the invention due to expansion of the frame or deformation of the screening material is relieved by flexing of the spline. The wire is therefore not stressed to the point of rupture and the insulative coating on the wire is not damaged by being pulled tautly over a sharp corner.

The screen may include one or more electrical switching elements located within the frame and connected in a series relationship with the wire, the switching element being adapted to close for the frame in position covering the opening of the building and to open for the frame moved out of that position. The electrical switching element may include a magnetically actuated reed switch which is normally in an open condition and is actuated to a closed condition when placed in a predetermined orientation relative to a magnet adjacent the opening. The magnet causes the reed switch to close for the frame in position covering the opening in the building. The electrical switching element may also be a mercury switch which opens when the screen frame is turned through more than a predetermined angle in a vertical plane from its installed position.

The electrical switching elements and all the electrical connections in the screen circuit may be entirely encapsulated in a silicone or other sealing compound within the screen frame to prevent tampering and corrosion or other damage to those elements. The screen is therefore impervious to water and may be bent somewhat or struck without damaging the switching element. The screen thus constructed also cannot be removed from its frame to enable an intruder to pass without breaking the circuit and sounding the alarm.

The security screen arrangement of the instant invention can be easily and economically produced either by manufacture of an entirely new screen or by retrofitting an existing screen. The retrofitting of an existing screen to the specification of the instant invention may be accomplished without removing the screening material from its frame. The conductive wire is simply laid in the desired pattern on the screening material and is secured thereto with a simple heat weld or a cement of some kind. The wires are barely visible on the screening material and there are no puckered areas thereon because not stitching has taken place. As noted above, the portions of the wire within the splining channel are laid over the spline itself and cemented or otherwise bonded thereto. The channel is then filled with sealer compound. The ends of the parallel portions of wire also need not be connected together mutually because the pattern of wires is formed from a continuous length. This reduces contact resistance and corrosion of solder joints. The retrofitting operation is completed by running the two ends of the wire into the frame through a small hole therein, where the joints between those wires and two external leads are entirely encapsulated in sealer compound. If one or more switching elements are used, an access hole is cut in the frame for insertion of each such switching element therein. The joints and the switching elements are then encapsulated in sealer.

BRIEF DESCRIPTION OF THE DRAWINGS

The above and other objects of the present invention may be fully understood from the following detailed description taken together with the accompanying drawings wherein similar reference characters refer to similar elements throughout and in which:

FIG. 1 is a front elevational view of one embodiment of a screen arrangement constructed in accordance with the instant invention;

FIG. 1A is a fragmentary enlarged front elevational view of the bottom end of the arrangement of FIG. 1;

DESCRIPTION OF THE PREFERRED EMBODIMENTS

Figure 2:
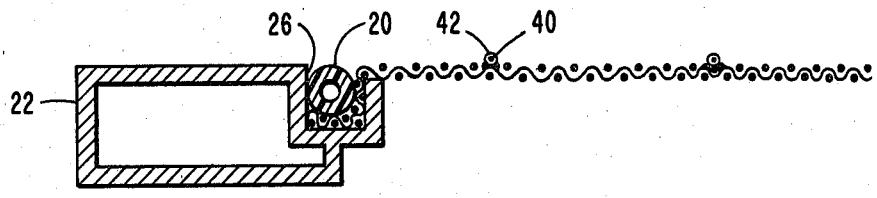
FIG. 2 is an enlarged fragmentary horizontal sectional view along the line 2—2 of FIG. 1.

Referring now to FIG. 1, there is illustrated one embodiment, generally designated 10, of the present invention. The embodiment 10 includes a conventional bug screen 12 and a sensing circuit 14 connected to an intrusion alarm depicted diagrammatically at 15.

The conventional screen 12 comprises a frame 16 with bug screening material 18 fixed thereto using a flexible spline 20. The frame 16 includes a plurality of hollow elongated side members 22 of substantially rectangular cross-section. The side members 22 may be arranged in a rectangle, as shown, or in any other desired shape. The aperature 24 thus formed by the frame 16 is bordered by the channel 26 along the interior edge of the frame and opening in a direction perpendicular to the plane which includes the aperture 24. The screening material 18 extends across the aperture 24 and overlaps the channel 26. The periphery of the screening material 18 is forced into and retained within the channel 26 by the flexible spline 20 which longitudinally engages the channel. The spline 20 is a conventional screen retaining spline of tubular cross-section adapted to be snuggly received within the channel 26 and to be frictionally retained therein.

Figure 3:
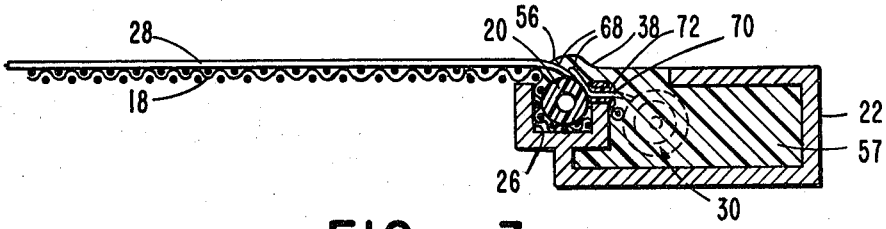
FIG. 3 is an enlarged fragmentary vertical sectional view taken along line 3—3 of FIG. 1.

The sensing circuit 14 comprises a continuous conductive wire 28 and an electrical switching element 30 connected in series across the leads 32 of the alarm system 15. The continuous conductive wire 28 overlies the screening material 18 and is heat welded or bonded thereto in a configuration having a series equally spaced parallel lengths of wire 34 extending between two of the side members 22 and joined by a plurality of relatively short transverse lengths of wire 36, best seen in FIGS. 1 and 3, overlying the spline 20 in the channel 26 to form a continuous series circuit. The relatively short transverse lengths of wire 36 are bonded to the spline 20 and sealed within the channel 26 against the atmosphere by a sealer compound 38 applied to the channel 26. The sealer compount 38 may be of the silicone rubber type.

The continuous conductive wire 28 may have a core 40 having multiple conductor elements and be surrounded by an insulative coating 42. The diameter and appearance of the wire 28 should be as close as possible to that of the individual strands which form the screening material 18 so that the wire 28 will visually blend into the background formed by the screening material. The screening material 18 may be conventional bug screen made of fiber glass coated with polyvinyl chloride. In that case, the wire 28 is desirably constructed of seven-element, 32-gauge copper wire with a pvc coating. The size is then very comparable and the color and texture can be indistinguisable. Wire having more than one conductor element is used rather than the solid wire of prior security screens to allow stretching and flexing of the wire with the screen. This wire is fully satisfactory for use in intrusion alarm systems because the electrical power requirement in such systems is very low. It should be noted here that the relative size of the wire 28 as depicted in the drawings is greatly exaggerated for purposes of illustration.

The bond between the wire 28 and the screening material 18 may take the form of a heat bond, or weld, between the polyvinyl chloride coatings on the two elements, or the elements may be cemented together. The welding process is performed with a heat press which melts the two coatings somewhat as it presses the two elements together. This results in a fusing of the coatings to each other. A cement used for this purpose may be either the solvent type which liquefies a portion of the coatings and then evaporates to leave the coatings bonded together in a homogeneous mass, or a compatible bonding agent which undergoes chemical hardening to reach a state able to hold the elements together. The bond between the wire 28 and the spline 20 may be of a similar type. For this purpose, the spline 20 may be formed of polyvinyl chloride.

Figure 6:
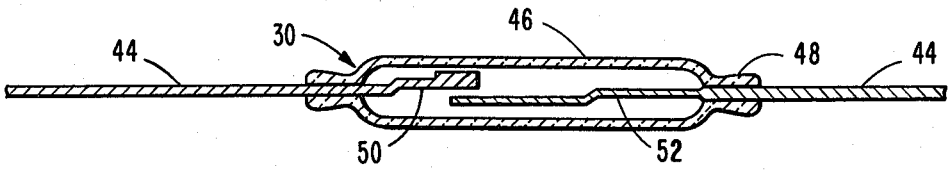
FIG. 6 is a sectional view of a magnetic reed switch of the type used in the instant invention in its normally open condition.
Figure 7:
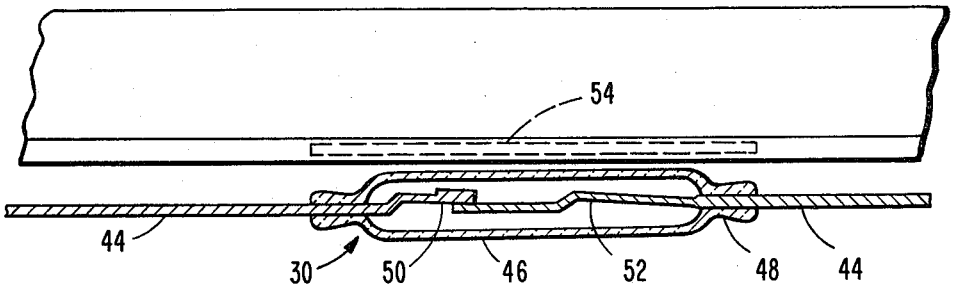
FIG. 7 is a sectional view of the reed switch of FIG. 6 in its closed condition adjacent a permanent magnetic.

The electrical switching element 30 is shown in FIG. 1 connected in series with the wire 28 and located within one of the side members 22 of the frame 16. The construction of the switching element 30 as a magnetically actuated reed switch is best shown in FIGS. 6 and 7. A pair of electrodes 44 extend into a substantially cylindrical glass or plastic sleeve 46 which is crimped at its two ends 48 to seal its interior from the atmosphere. The ends of the electrodes 44 form a pair of contacts 50 and 52 whose ends extend somewhat past each other but are normally spaced apart slightly to leave the switching element 30 in its open condition. The contact 52 is substantially longer and somewhat thinner than the contact 50, and is therefore more susceptible to being drawn in one direction or the other by an external magnetic field. FIG. 7 shows a permanent magnet 54 placed opposite the switching element 30 in an orientation which causes the contact 52 to be drawn against the contact 50, thereby placing the switching element 30 in its closed condition. Subsequent removal of the magnet 54 then allows the switching element 30 to return to the normally open condition of FIG. 6.

It will be understood that in some circumstances, such as when the screen 12 is relatively large, it may be desirable to incorporate more than one electrical switching element into the embodiment 10 to give added protection against tampering.

All of the security wiring except the continuous wire 28 and a pair of connector leads 55 is enclosed within the frame 16 and is entirely encapsulated within a pair of masses 56 and 57 of a sealer compound similar to the compound 38. The pair of connector leads 55 enter the frame 16 through a hole 59 and are sealed thereagainst by a grommet 61. The leads 55 may be tied to form a knot 63 within the frame 16 directly below the hole 59 to prevent the leads 55 from being pulled therefrom. The two ends of the wires 28 extend into the frame 16 through a small hole leading through the wall of the frame 16 from a point within the channel 26. The ends of the wire 28 are connected to the corresponding connector lead 55 at a point within the frame 16, as by solder joints 64. The solder joints 64 may be insulated with conventional shrink sleeves or the like (not shown) to prevent shorting of the joints with the interior of the frame 16. The knot 63, the solder joints 64 and all of the adjoining wires within the frame 16 are then embedded within the mass 56 to completely seal them from the elements and to more securely anchor them within the frame 16. The connector leads 55, and the wire 28 in series therewith, are placed in series with the alarm system 15 by a connector 66 which operatively joins the leads 55 to the leads 32 of the alarm system. The connector 66 may have gold plated contacts to reduce its electrical resistance and inhibit corrosion.

The switching element 30 is located within the lower end of the frame 16, as best shown in FIG. 1A. The wire 28 is severed and the two leads 68 produced thereby are passed through a small opening 70 from the channel 26 to the interior of the frame 16. A small nylon grommet 72 may protect the leads 68 as they pass through the opening 70. The switching element 30 is placed within the frame 16 through an elongated opening 74 in the side thereof. The leads 68 are connected to the respective ends of the switching element 30, as by solder joints 76. The solder joints 76 are preferably insulated from the frame 16 by conventional shrink sleeves in the manner described above relative to the solder joints 64. After the circuitry is placed into the frame 16, a liberal amount of a silicone or other sealing compound is pumped into the frame 16 through the elongated opening 74 to form the mass 57. The compound thus entirely seals the circuitry at the lower end of the screen. It may be smoothed at the opening 74 to provide an outer surface which is substantially flush with the outer surface of the frame 16. It will be noted from the above discussion that all points of electrical connection in the screen circuit are encapsulated in sealer within the frame 16 and are therefore entirely protected from corrosion or shorting due to moisture. The same structure helps protect the wiring and the electrical switching element 30 from damage if the frame 16 is accidentally bent or struck, and prevents an intruder from tampering therewith. The screening material 18 cannot be removed from the channel 26 by an intruder without breaking the circuit and setting off the alarm 15 because the wires forming the sensing circuit pass into and are secured to the screen frame. Further, attempted removal of even the spline 20 from the channel 26 for the purpose of removing the screening material from the channel causes the wires bonded to the spline to be ripped or broken, setting off the alarm.

A conventional bug screen can be easily retrofitted to produce the security screen of the instant invention by heat sealing or cementing the wire 28 onto the screening material 18 and to the flexible spline 20 while the screening material and the spline are in position within its frame 16. The material can be mounted on a jig to assure accurate placement of the wire thereon, and be heat pressed on, if desired. The electrical switching element and the remainder of the wiring can then be installed within the frame by drilling access openings therein as described above, including the small opening 70 and the elongated opening 74.

The intrusion alarm system 15 may include a conventional alarm designed to monitor the continuity of a normally closed conductive path and to produce a warning signal when that path is broken. Such alarms often have a circuit for passing a constant low current through the conductive path to monitor its continuity. The alarm automatically produces a warning signal when the current ceases. The leads 55 of the continuous conductive wire 28 are connected to the leads 32 of the alarm system 15 which passes a constant low current therethrough. A person breaking or cutting through the screening material 18 and the wire 28, or removing the spline 20 from the channel 26, will cause a discontinuity in the electrically conductive path 14 and cessation of the current therethrough. The warning signal is then produced by the alarm system 15. The same result is achieved if the frame 16 is moved from the condition in which the switching element 30 is adjacent the permanent magnet 54.

Figure 4:
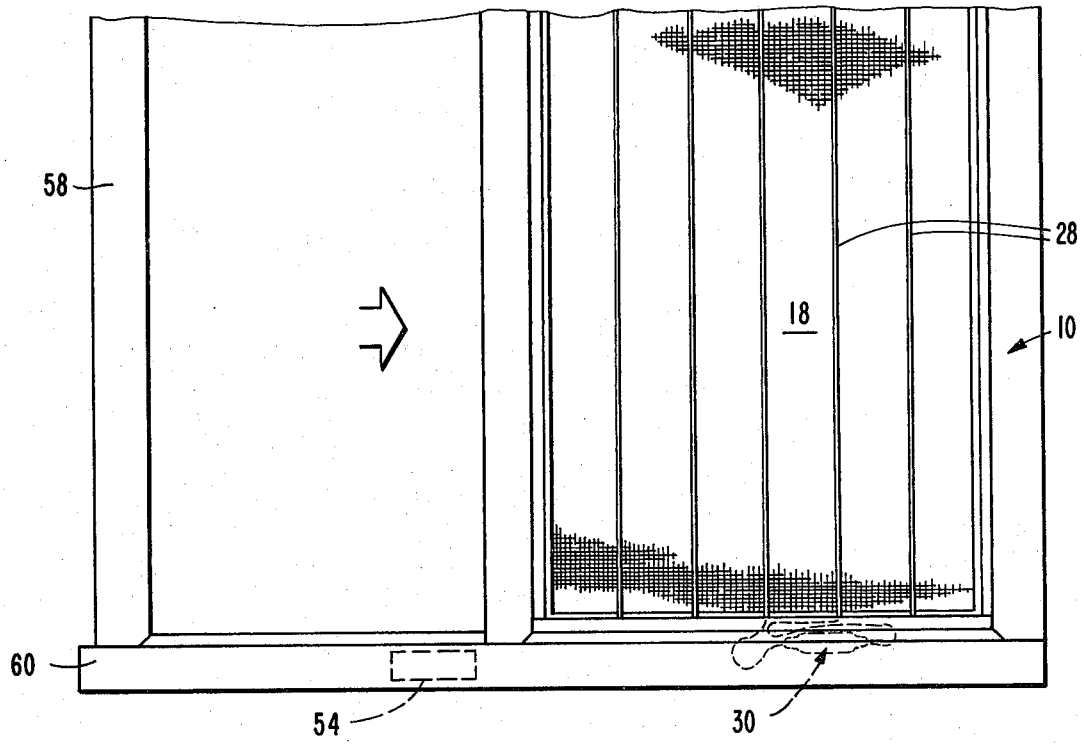
FIG. 4 is a fragmentary front elevational view of the screen arrangement of FIG. 1 installed within a window and screen track.
Figure 5:
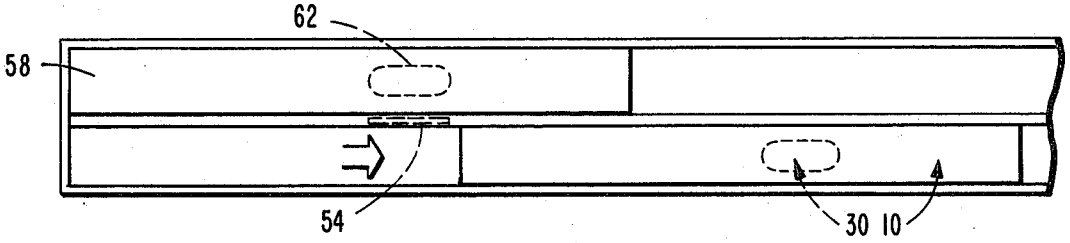
FIG. 5 is a top plan view of the apparatus of FIG. 4.

FIGS. 4 and 5 show the embodiment 10 and a corresponding window 58 in place within a window track 60. The electrical switching element 30 and the permanent magnet 54 are shown in broken lines therein. An electrical switching element 62 is also shown within the window 58. The electrical switching element 62 is identical in construction and operation to the switching element 30 in the embodiment 10, except that it is located within the frame of the window 58. FIGS. 4 and 5 show the window 58 in its fully closed condition and the embodiment 10 in an open condition. The embodiment 10 has been moved in the direction indicated from its closed position directly opposite the window 58. The circuit which includes the electrical switching element 62 is therefore closed by operation of the magnet 54 on that element, while the circuit of the switching element 30 is open due to removal of the switching element 30 from its position opposite the magnet 54.

In operation, the entire sensing circuit 14 remains in the closed condition whenever each of the screens, windows and doors to which this system is connected remains closed and intact. Any change in that condition immediately opens the sensing circuit 14 and causes the intrusion alarm to produce a warning signal. Cutting or breaking any part of the wire 28 or moving the embodiment 10 or the window 58 will be detected in this way. It is to be understood that in most circumstances, securing a window screen with the embodiment 10 will be sufficient without a separate alarm connection to the corresponding window 58. Any entry through a particular window opening having a screen must be accomplished by first cutting or removing the screen, an act which itself would sound the alarm.

Figure 8:
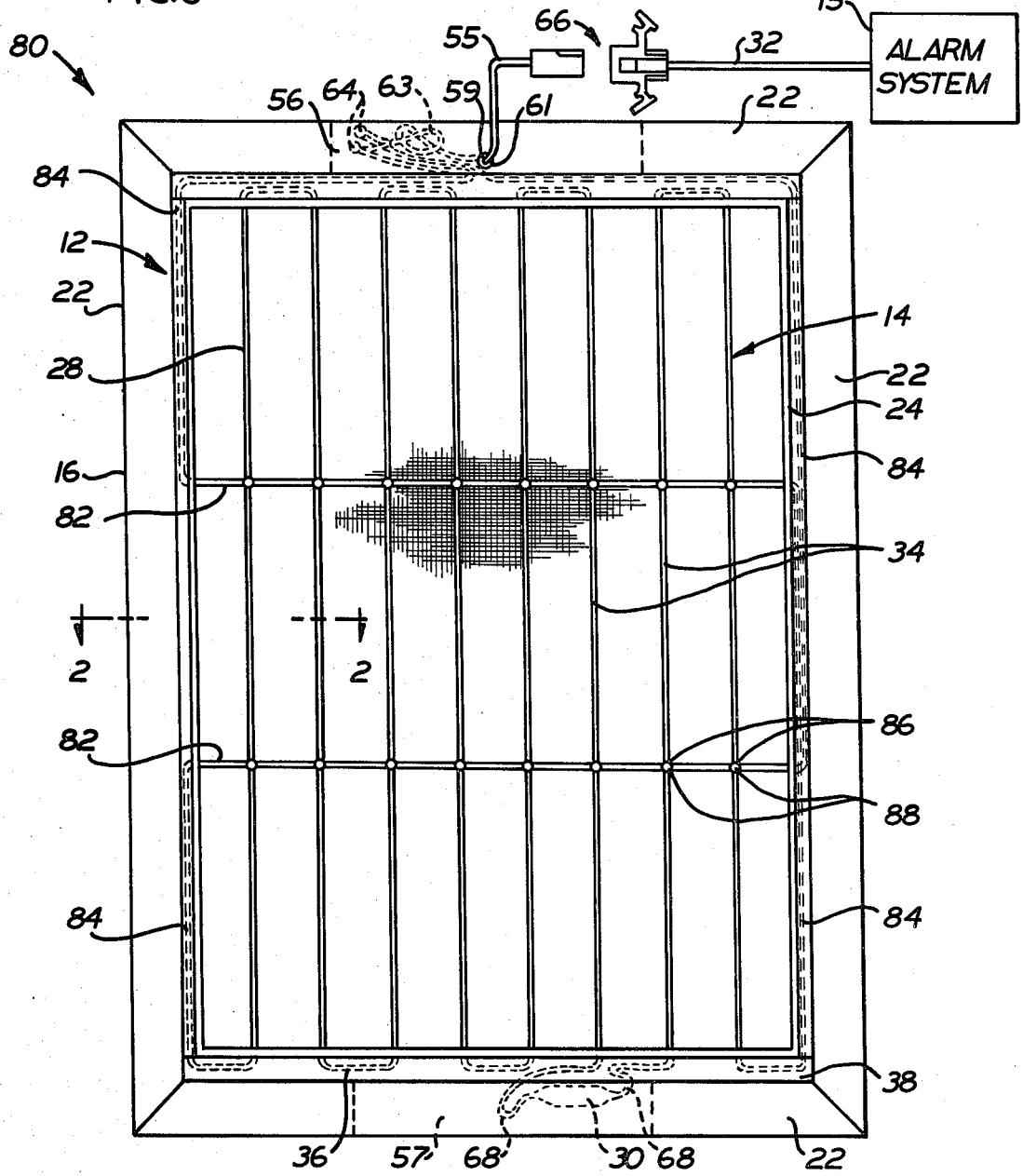
FIG. 8 is a front elevational view of a second embodiment of a screen arrangement constructed in accordance with the instant invention.

FIG. 8 illustrates a second embodiment of the present invention, generally designated 80. The embodiment 80 is identical to the embodiment 10 discussed above, except for the addition of transverse lengths of wire 82 overlying and bonded to the screening material 18 across the aperture 24. The elements of the embodiment 80 which are similar to elements of the embodiments 10 are denoted by the same reference numerals in the drawings, and the description of those elements and their general operation in relation to the embodiment 10 are equally applicable here.

The transverse lengths of wire 82 are perpendicular to the parallel lengths of wire 34, and are connected in series therewith by wire segments 84 running along the channel 26. The wire segments 84 overlie and are bonded to the spline 20 within the channel 26. The transverse lengths 82 thus become a portion of the sensing circuit 14, providing added protection against unauthorized passage of a person through the aperture 24.

The transverse lengths 82 are electrically insulated from the parallel lengths 34 at the locations 86 where the transverse lengths 82 cross the parallel lengths 34 and are bonded thereto. As discussed above in relation to the embodiment 10, the various lengths of wire and the screening material 18 may be coated with polyvinyl chloride to provide the necessary electrical insulation and to enable the elements to be easily welded, glued or otherwise bonded together.

Figure 9:
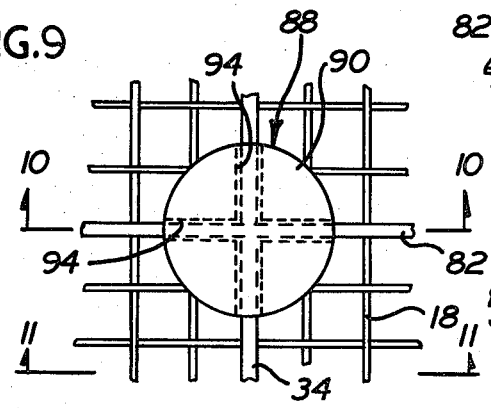
FIG. 9 is an enlarged fragmentary front elevational view of the screen illustrated in FIG. 8, showing one of the mechanical interlock buttons thereof.
Figure 10:
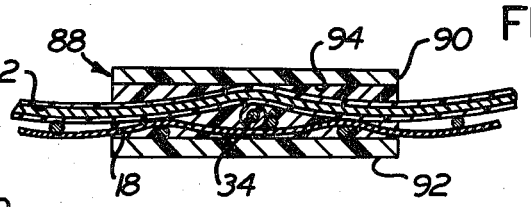
FIG. 10 is a horizontal sectional view taken along the line 10—10 of FIG. 9.
Figure 11:
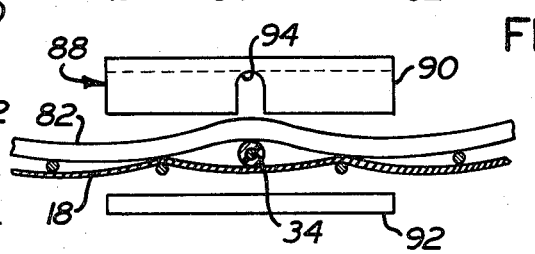
FIG. 11 is an exploded side elevational view of the apparatus illustrated in FIG. 8, taken in the direction 11—11.

The points of crossing or intersection of the lengths of wire at the locations 86 are made tamper-proof by buttons 88 welded or glued in place to encapsulate the wires and the screening material adjacent thereto. As seen best in FIGS. 9, 10 and 11, the buttons 88 comprise front and back disc elements 90 and 92 engaging the front and back sides, respectively, of the embodiment 80 at the locations 86. The front disc elements 90 are provided on one side with perpendicular recessed regions 94 able to receive the lengths of wire 82 and 34 adjacent the locations 86 for bonding thereto and to the screening material 18. The recessed regions 94 may be of the same size or may be sized differently to more closely engage both the underlying and the overlying wires at the locations 86. The back disc elements 92 are essentially flat for bonding to the underside of the screening material 18 at the locations 86 in a condition parallel to and aligned with the front disc elements 90. The buttons 88 are preferably made of polyvinyl chloride and held in place by a suitable cement 96.

When the disc elements 90 and 92 are welded or glued in place at one of the locations 86, the transverse length of wire 82 passing therethrough is mechanically interlocked with the corresponding parallel length of wire 34 and the screening material such that the components cannot be disassembled in any way without breaking the sensing circuit 14 and setting off the alarm. The extent to which the screening material 18 can be slit longitudinally without setting off the alarm is thus limited by the placement of the transverse lengths 82. It has been found that placement of the lengths 82 no more than two feet apart across the aperture 24 of the frame 16 prevents passage of an intruder without breaking the sensing circuit. One or more of the transverse lengths of wire 82 will necessarily be broken if passage is attempted by slitting the screen as far as possible without cutting a wire and then pulling the screen apart at the slit. When this is done, a great amount of stress is applied to the nearest transverse length 82 through the leverage of the parallel lengths of wire 34, causing the transverse length to rupture.

In manufacture, the transverse lengths 82 and the parallel lengths 34 may be formed of a single homogeneous length of wire laid over the screening material 18 in the desired configuration and welded or otherwise bonded thereto. The switching element 30 can then be spliced into the single length of wire, as discussed in relation to the embodiment 10, and the switching elements and the splices can be embedded in a mass of sealer compound within the frame 16. The resulting sensing circuit thus has no exposed connections which can corrode or be easily circumvented. The front and back disc elements 90 are bonded to the respective sides of the screen arrangement at the locations 86, forming the buttons 88 mechanically interlocking the transverse lengths 82 with the parallel lengths 34 and the screening material 18. The resistance of the device to tampering may be enhanced by liberally applying the cement 96 to the disc elements 90 before applying them to the screen arrangement, thereby filling the voids formed by the perpendicular recessed regions 94 and the openings in the mesh screening material 18. The interlock buttons 88 thus formed are solid and provide maximum protection from tampering.

This concludes the description of the preferred embodiments of the present invention. From the above, it can be seen that there has been provided an improved security screen arrangement which may be easily and economically manufactured from all new components or retrofitted onto an existing screen. The arrangement retains substantially the same appearance as a conventional screen which does not form a part of the alarm system, and has excellent resistance to moisture and other elements which are known to cause deterioration.

The appended claims are intended to cover all variations and adaptations falling within the true scope and spirit of the present invention.

I claim:

1. A partially conductive security screen arrangement for use with an intrusion alarm system designed to operate in a normally closed sensing circuit condition and to produce a warning signal when the sensing circuit is broken, said arrangement comprising:

screen apparatus including a frame defining a central aperture, screening material comprising a mesh of interwoven strands covering said aperture and having a plastic coating, and means for securing the periphery of said screening material to said frame to close said aperture, said screen apparatus positionable to cover an opening in a building;

electrically conductive means continuous between two ends thereof, including wire means having a plastic coating and at least partially overlying said screen apparatus, said wire means being bonded to the screening material by thermal fusing of the respective plastic coatings to prevent passage of a human being through said aperture unless said conductive means is severed, means for connecting said conductive means at the two ends thereof into the sensing circuit as a series element thereof;

whereby passage of a human being through the opening for said screen apparatus in position to cover said opening breaks the sensing circuit.

2. The arrangement defined in claim 1 wherein said wire means is laid over and fused to said screening material in a configuration which comprises a series of parallel longitudinal lengths of wire extending between opposite ends of said frame and connected together by relatively short lengths of wire to form a continuous series circuit, said wire means being homogeneous at the point of connection between said longitudinal lengths and said relatively short lengths.

3. The arrangement defined in claim 2 wherein said configuration of said wire means further comprises at least one transverse length of wire connected in series with the remainder of said wire means and extending between opposite sides of said frame in a direction substantially perpendicular to said longitudinal lengths of wire, said at least one transverse length being bonded to and electrically insulated from said longitudinal lengths at the points at which said at least one transverse length intersects said longitudinal lengths within said aperture.

4. The arrangement defined in claim 3 wherein said wire means is homogeneous at the points of series connection between said at least one transverse length and the remainder of said wire means.

5. The arrangement defined in claim 3 further comprising means for mechanically interlocking said at least one transverse length of wire with said longitudinal lengths of wire and said screening material at said points of intersection, such that an attempt to separate said lengths of wire from each other or from said screening material will break the sensing circuit.

6. The arrangement defined in claim 5 wherein said transverse lengths of wire are spaced from each other across said aperture at intervals of no more than two feet.

7. The arrangement defined in claim 5 wherein said interlocking means comprises first interlock elements overlying and engaging said lengths of wire at said points of intersection and second interlock elements aligned with said first interlock elements, respectively, and engaging the underside of said screening material, said first and second interlock elements being bonded to said lengths of wire and said screening material at said points of intersection.

8. The arrangement defined in claim 7 wherein said first and second interlock elements comprise first and second disc elements, said first disc elements having pairs of perpendicular recessed grooves on the undersides thereof for close reception of the portions of said lengths of wire adjacent said points of intersection.

9. The arrangement defined in claim 8 wherein said first and second interlock elements are plastic and the coatings of said mesh and said wire means are made of polyvinyl chloride.

10. The arrangement defined in claim 9 wherein said first and second interlock elements are glued to said polyvinyl chloride coatings of said lengths of wire and said screening material.

11. The arrangement defined in claim 9 wherein said first and second interlock elements are welded to said polyvinyl chloride coatings of said lengths of wire and said screening material.

12. The arrangement defined in claim 2 wherein said means for securing the periphery of said screening material to said frame comprises a continuous channel formed in said frame at an inner edge thereof and a flexible plastic spline of tubular cross-section forced longitudinally into said channel and frictionally retained therein with said periphery of said screening material sandwiched therebetween, said longitudinal lengths of wire extending across said aperture to locations overlying said spline within said channel, at which locations said lengths of wire and the relatively short lengths connecting them are bonded to the spline and to the channel by encapsulation within a mass of sealer compound applied thereto.

13. The arrangement defined in claim 1 which includes switching means having an electrical switching element located within a hollow portion of said frame and connected in a series relationship with said wire means, said electrical switching element being adapted to close for said frame in position covering the opening in the building and to open for said frame moved out of that position, and wherein all electrical connections between said wire means and said electrical switching element are located adjacent said electrical switching element within said hollow portion of said frame.

14. The arrangement defined in claim 13 wherein said means for connecting said conductive means into said sensing circuit includes two lead wires, and all electrical connections between said conductive means and said lead wires are located within said hollow portion of said frame.

15. The arrangement defined in claim 14 which includes a sealer compound within said hollow portion of said frame completely encapsulating said electrical connections and said electrical switching element.

16. The arrangement defined in claim 15 wherein said electrical switching element comprises a mercury switch.

17. The arrangement defined in claim 15 wherein said electrical switching element comprises a magnetically actuated reed switch biased toward a normally open condition and said switching means includes a magnet positioned adjacent said opening to cause said magnetically actuated reed switch to close for said frame in position covering the opening in the building.

18. The arrangement defined in claim 17 wherein said wire means comprises a core having a plurality of conductor elements.

19. A partially conductive security screen arrangement for use with an intrusion alarm system designed to operate in a normally closed sensing circuit condition and to produce a warning signal when the sensing circuit is broken, said arrangement comprising:

screen apparatus including a frame defining a central aperture, screening material comprising a mesh of interwoven strands covering said aperture and means for securing the periphery of said screening material to said frame to close said aperture, said screen apparatus positionable to cover an opening in a building;

electrically conductive means continuous between two ends thereof, including wire means similar in appearance to said strands at least partially overlying said screen apparatus and bonded thereto to prevent passage of a human being through said aperture unless said conductive means is severed, said wire means including at least two lengths of wire extending across said frame and intersecting within the aperture, said lengths of wire being electrically connected in series with each other;

means for mechanically interlocking said at least two lengths of wire with each other and said screening material at the points of intersection of the lengths of wire, such that an attempt to separate said lengths of wire from each other or from said screening material will break the sensing circuit; and means for connecting said conductive means at said two ends thereof into the sensing circuit as a series element thereof;

whereby passage of a human being through the opening for said screen apparatus in position to cover said opening breaks the sensing circuit.

20. The arrangement defined in claim 19 wherein said interlocking means comprises first interlock elements overlying and engaging said lengths of wire at said points of intersection and second interlock elements aligned with said first interlock elements, respectively, and engaging the underside of said screening material, said first and second interlock elements being bonded to said lengths of wire and said screening material at said points of intersection.

21. The arrangement defined in claim 20 wherein said first and second interlock elements comprise first and second disc elements, said first disc elements having pairs of recessed grooves on the undersides thereof for close reception of the portions of said lengths of wire adjacent said points of intersection.

22. The arrangement defined in claim 21 wherein said first and second interlock elements are glued to said lengths of wire and said screening material.

23. A partially conductive security screen arrangement for use with an intrustion alarm system designed to operate in a normally closed sensing circuit condition and to produce a warning signal when the sensing circuit is broken, said arrangement comprising:

screen apparatus including a frame defining a central aperture, screening material comprising a mesh of interwoven strands covering said aperture and means for securing the periphery of said screening material to said frame to close said aperture, said screen apparatus positionable to cover an opening in a building;

electrically conductive means continuous between two ends thereof, including wire means similar in appearance to said strands at least partially overlying said screen apparatus and bonded thereto to prevent passage of a human being through said aperture unless said conductive means is severed, said wire means including a series of parallel longitudinal lengths of wire extending between opposite ends of said frame and at least one transverse length of wire extending between opposite sides of said frame in a direction intersecting the longitudinal lengths substantially perpendicularly within the aperture, said longitudinal and transverse lengths of wire being electrically connected in series with each other;

means for mechanically interlocking said at least one transverse length of wire with said longitudinal lengths of wire and said screening material at the points of intersection of the lengths of wire, such that an attempt to separate said lengths of wire from each other or from said screening material will break the sensing circuit; and means for connecting said conductive means at said two ends thereof into the sensing circuit as a series element thereof;

whereby passage of a human being through the opening for said screen apparatus in a position to cover said opening breaks the sensing circuit.

24. The arrangement defined in claim 23 wherein said interlocking means comprises first interlock elements overlying and engaging said lengths of wire at said points of intersection and second interlock elements aligned with said first interlock elements, respectively, and engaging the underside of said screening material, said first and second interlock elements being bonded to said lengths of wire and said screening material at said points of intersection.

25. The arrangement defined in claim 24 wherein said first and second interlock elements comprise first and second disc elements, said first disc elements having pairs of perpendicular recessed grooves on the undersides thereof for close reception of the portions of said lengths of wire adjacent said points of intersection.

26. The arrangement defined in claim 25 wherein said first and second interlock elements are plastic and said mesh and said wire means have polyvinyl chloride coatings.

27. The arrangement defined in claim 26 wherein said first and second interlock elements are glued to said polyvinyl chloride coatings of said lengths of wire and said screening material.

28. The arrangement defined in claim 25 wherein said means for securing the periphery of said screening material to said frame comprises a continuous channel formed in said frame at an inner edge thereof and a flexible plastic spline of tubular cross-section forced longitudinally into said channel and frictionally retained therein with said periphery of said screening material sandwiched therebetween, said longitudinal and transverse lengths of wire extending across said aperture to locations overlying said spline within said channel, at which locations said lengths of wire are bonded to the spline and to the channel by encapsulation within a mass of sealer compound applied thereto.

* * * * *